United States Patent [19]

Miller

[11] 4,198,112

[45] Apr. 15, 1980

[54] TORQUE LIMITED MALE SCREW BASE FOR LAMPHOLDER FITTING

[76] Inventor: Jack V. Miller, 700 N. Auburn Ave., Sierra Madre, Calif. 91024

[21] Appl. No.: 944,390

[22] Filed: Sep. 21, 1978

[51] Int. Cl.[2] ..... H01R 11/02

[52] U.S. Cl. ..... 339/176 L; 339/50 R

[58] Field of Search ..... 339/50 R, 67, 146, 176 L, 339/178, 179

[56] References Cited

U.S. PATENT DOCUMENTS

| | | | |
|---|---|---|---|
| 808,096 | 12/1905 | Lawrence, Jr. | 339/67 |
| 2,972,125 | 2/1961 | Temple et al. | 339/67 |
| 3,644,867 | 2/1972 | Krause | 339/176 L |

*Primary Examiner*—Joseph H. McGlynn

[57] ABSTRACT

A male screw base for a lampholder fitting has a cylindrical insulative body having a helical groove in its exterior surface, in which a helical spring is loosely disposed. Both ends of the helical spring are bent inwards and protrude through a slot at either end of the groove to extend into a hollow interior of the body. The inside diameter of the spring is spaced from the bottom surface of the groove a distance equal to the thread depth of the female threads of an Edison-based lampholder. The bent ends of the spring are normally in contact with the near ends of their respective slots, whereby excessive installation torque will wind up the spring, reducing its diameter a sufficient distance to become disengaged from the lampholder thread grooves. A conductor is connected to one of the spring ends, and a second conductor is provided as a center contact coaxially extending from one end of the cylindrical body. The end of the body opposite the center connector is adapted for attachment to a lampholder fitting. In one preferred embodiment a ring-shaped third electrical contact is coaxially spaced from the center contact.

7 Claims, 5 Drawing Figures

TORQUE LIMITED MALE SCREW BASE FOR LAMPHOLDER FITTING

BACKGROUND OF THE INVENTION

This invention relates to lampholder fittings that are adapted to screw into the Edison base lampholder sockets commonly used for supporting and operating light bulbs in lighting fixtures and portable lamps, and more particularly to the male screw bases that are used to permit the use of fluorescent lampholder fittings and other electrical devices in ordinary incandescent lamp sockets.

There are a number of lampholder fittings currently available which are adapted to fit Edison base lampholders (commonly called female sockets) and to provide both mechanical support and electrical input power for various devices including fluorescent lamp systems. Since most of the devices are substantially larger than the incandescent light bulbs for which the lampholder was originally designed, there is a known safety hazard that may occur from over-torqueing the lampholder fitting into the lampholder. In such cases, the ability to grip a lampholder more firmly than is possible with an ordinary light bulb creates excessive torque to the degree that the lampholder is damaged. Further, an overtightened lampholder fitting tends to freeze in place to the extent that the lampholder may be damaged when the lampholder fitting is unscrewed.

The magnitude of the described problem is great enough that certain safety testing agencies have placed limitations on the type of device that can be installed in an Edison base lampholder.

The object of this invention is to provide a male screw base that cannot apply any excessive torque load on a lampholder, either during installation or removal of the lampholder fitting to which the screw base is attached.

BRIEF DESCRIPTION OF THE DRAWINGS

The features of the preferred embodiments of the invention are illustrated in the drawings in which.

DETAILED DESCRIPTION OF THE PREFERRED EMBODIMENTS

Figure 1:
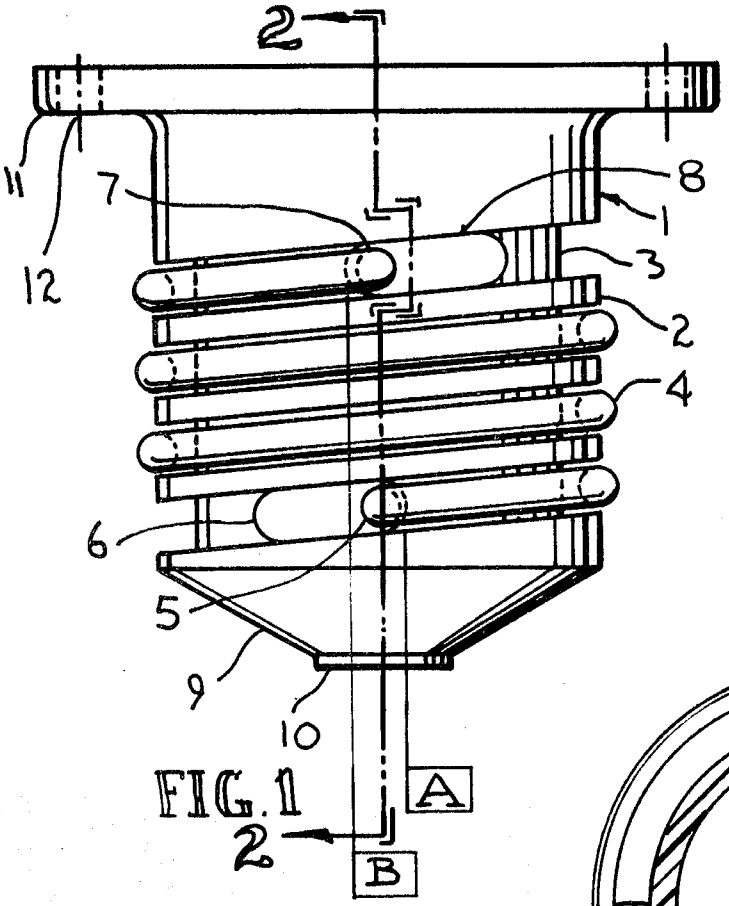
FIG. 1 is a side elevation view of the male screw base which is adapted for attachment to a lampholder fitting.

In FIG. 1 a male screw base 1 is shown having a generally cylindrical insulative body 2. A helical groove 3 extends along substantially the full length of the cylindrical body 2, and disposed within the helical groove 3 is a conductive helical spring 4. The groove 3 has a pitch to match the thread pitch of a female Edison base lampholder, so that the helical spring 4 disposed within the groove 3 will be adapted to engage the female threads of a lampholder. Groove 3 is of sufficient depth to receive substantially all of spring 4, and is of sufficient width to loosely restrain spring 4 in the axial direction. A first end 5 of spring 4 is bent inwards into a slot 6 in the body 2, and a second end 7 of spring 4 is also bent inwards into a slot 8 in body 2. In a normal free position spring end 5 is in contact with the end of slot 6 nearest the helical part of the spring, shown as position "A", and spring end 7 is also in contact with the end of slot 8 nearest the helical part of the spring, shown as position "B"; whereby in the free position spring 4 is limited to little or no rotational movement about the body 2. One end of body 2 is closed be a generally conical wall 9 in which a center contact 10 is coaxially disposed. The opposite end of body 2 is provided with a mounting means 11 containing a plurality of fastener holes 12 suitable for the use of fasteners to mount the male screw base to a lampholder fitting.

Figure 2:
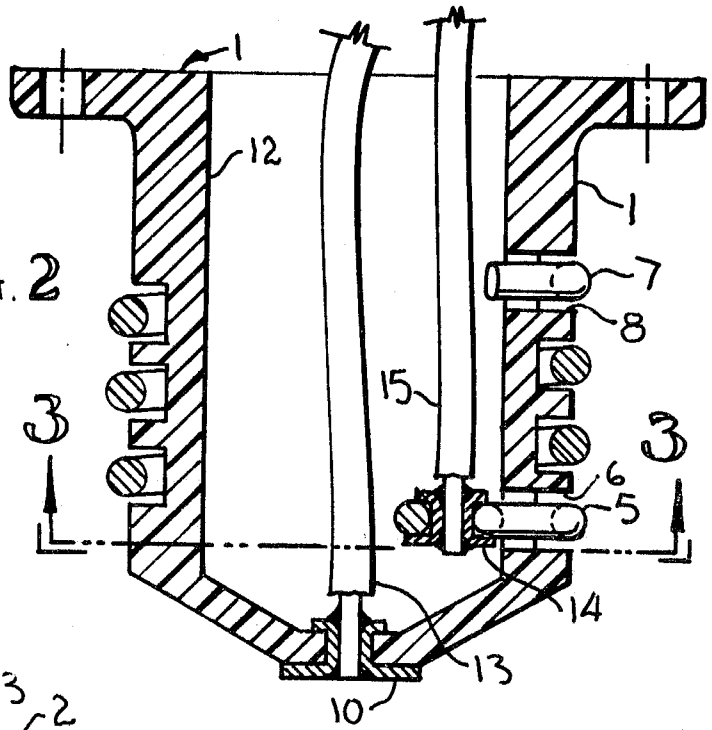
FIG. 2 is a cross-sectional view of the screw base of FIG. 1, taken along section line 2—2.

In FIG. 2 a cross-sectional view of the male screw base of FIG. 1 is shown taken along section line 2—2 and in which body 2 is shown having a hollow cavity 12. Center contact 10 has an insulated electrical conductor 13 connected thereto and extending through cavity 12 to provide input power to an attached lampholder fitting which is not shown in the interest of clarity. End 5 of spring 4 is shown protruding through slot 6 and into cavity 12, and terminating at an electrical terminal means 14 to which a second insulated conductor 15 is attached and extends through cavity 12 to provide a second power connection for a lampholder fitting.

Figure 3:
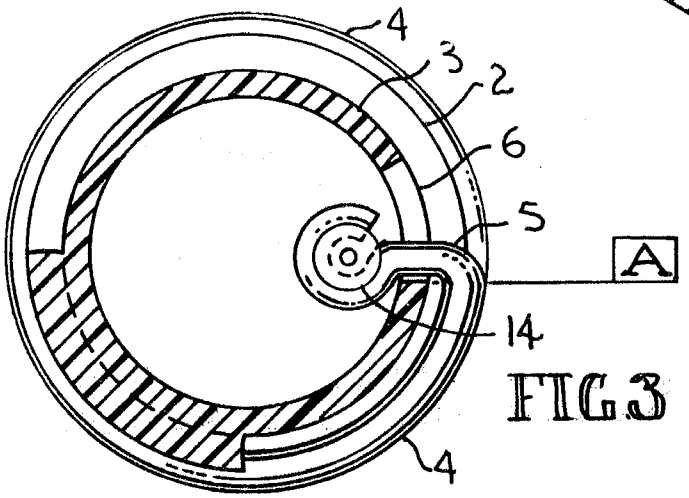
FIG. 3 is a cross-sectional view of the screw base of FIG. 2, taken along section line 3—3.

In FIG. 3 a cross-sectional view of the male screw base is shown taken along section line 3—3 of FIG. 2. The depth of helical groove 3 may be seen in body 2, said depth being sufficient to permit spring 4 to substantially retract within the outer diameter of body 2 under high applied "wind-up" torque. End 5 of spring 4 is shown resting against the end of slot 6 at position "A" where end 5 is adapted to secure terminal 14.

Figure 4:
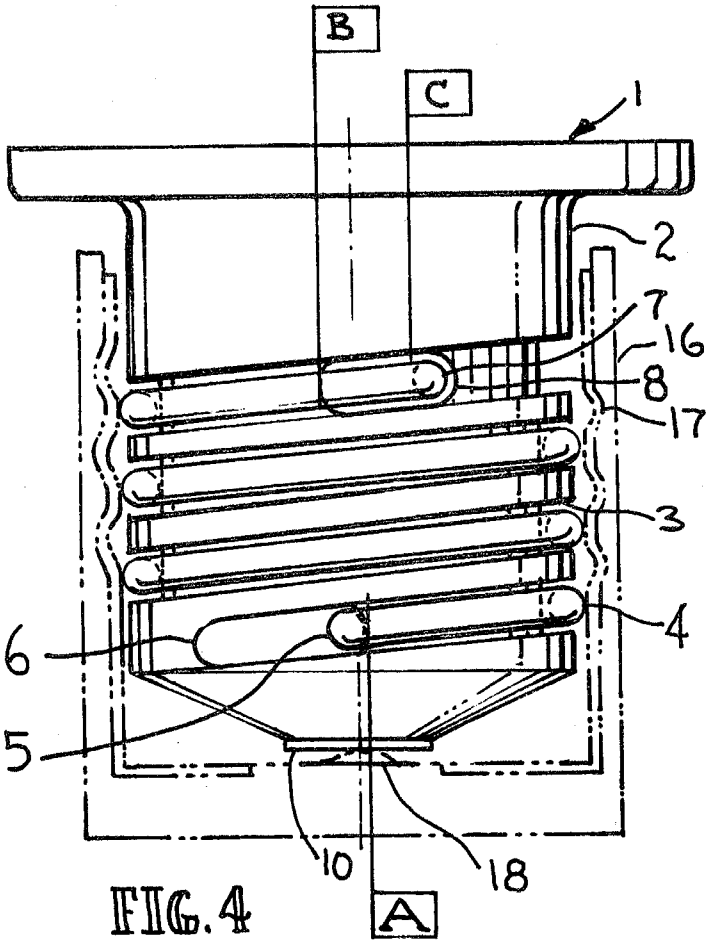
FIG. 4 is a side elevation view of the screw base of FIG. 1, shown under maximum torque condition within a lampholder.

In FIG. 4 the screw base 1 is shown being screwed into a female thread in an Edison base lampholder 16, shown in phantom. The screw base 1 has in the condition shown been subjected to high installation torque as contact 10 bears against the center contact 18 of lampholder 16. As the screw base 1 is torqued further clockwise, end 5 of spring 4 is pulled against the end of slot 6 at position "A" which causes the spring 4 to be wound up to a smaller diameter, pulling the outside diamater of spring 4 away from the female threads 17 of lampholder 16, causing thread disengagement and relief of the excessive torque without structural damage to lampholder 16. As the diameter of spring 4 is reduced, the trailing end 7 of spring 4 moves radially in slot 8 from the free position "B" to the overtorque position "C".

If the torque is applied in the counter-clockwise direction, body 2 first rotates without movement of spring 4. The first movement of the helical groove 3 on spring 4 produces an axial component of the radial movement which relieves the force against contact 18 by contact 10. Further radial movement in the counter-clockwise direction moves slot 8 so that its trailng edge rotates from position "B" to position "C", and slot 6 also moves so its leading edge is spaced away from position "A". Spring 4 is then wound up to a reduced diameter by the further movement of the trailing edge of slot 8 against end 7 of spring 4, while end 5 of spring 4 floats freely within slot 6.

Figure 5:
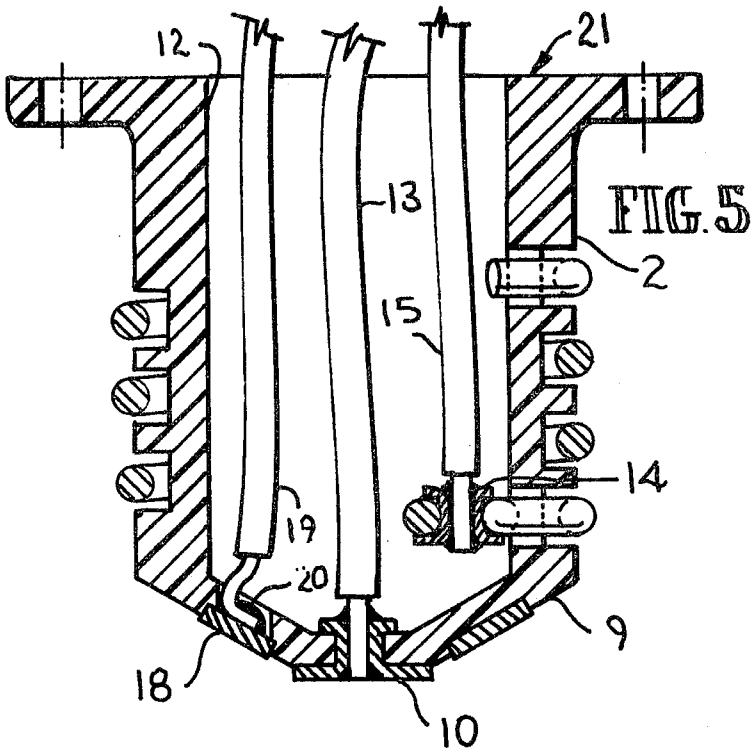
FIG. 5 is a cross-sectional view of a three-way screw base adapted for use in a conventional three-way lampholder.

In FIG. 5 another preferred embodiment of the male screw base 21 is shown in a cross-sectional view taken generally along the central axis, wherein an intermediate ring contact 18 supported on conical surface 10 of body 2. Ring contact 18 is so positioned as to engage an intermediate contact within a conventional three-way lampholder commonly used on portable lamps. Ring contact 18 is provided with an electrical attachment 20 to an insulated conductor 19 extending through cavity 12 of body 2, whereby in combination with conductor 13 from center conact 10 and conductor 15 from terminal 14 three way operation of an attached lampholder fitting is accomplished.

I claim:

1. A male screw base for a lampholder fitting comprising:

a generally cylindrical, electrically insulative, hollow body having a helical groove in its cylindrical surface;

a slot at each end of the helical groove in the body which extends into the hollow interior of the body;

an electrically conductive helical spring loosely disposed whithin the helical groove and having a major diameter and pitch approximately equal to the major diameter and pitch of a female Edison base lampholder;

each end of the helical spring bent inwards, passing through the respective slots in the helical groove, and extending into the hollow interior of the body;

a center electrical contact disposed coaxially at one end of the cylindrical body;

means for attachment to a lampholder fitting provided at the second end of the cylindrical body;

an electrical conductor attached to one end of the helical spring and passing through the insulative body to extend from the attachment end of the body, suitable for electrical connection to a lampholder fitting; and a second electrical conductor attached to the center contact and passing through the body to extend fron the attachment end of the body, suitable for connection to a lampholder fitting.

2. A male screw base according to claim 1 in which the slots at the ends of the helical groove are approximately the same width as the helical groove and are substantially longer than the width, whereby the spring the helical spring has its ends loosely disposed in respective slots.

3. A male screw base according to claim 2 in which each end of the helical spring extending through its respective slot is in contact with the nearest end surface of the respective slot when the spring is in the free condition, and the slots are of sufficient length so that a torsional load applied to the spring in either direction will cause one end of the spring to move away from its nearest end surface of the respective slot and thereby reduce the outside diameter of the spring.

4. A male screw base according to claim 1 in which the outside diameter of the insulative body is slightly less than the minor thread diameter of a female Edison base lampholder, the helical spring outside diameter in the free condition is equal to or larger than the major thread diameter of the female Edison base lampholder, and the depth of the groove is approximately equal to the diameter of the spring wire.

5. A male screw base according to claim 1 in which an anular ring contact is disposed concentrically about the center contact, the ring contact also being provided with a third electrical conductor attached thereto and passing through the insulative body to extend from the attachment end of the body, suitable for electrical connection to an attached lampholder fitting.

6. A male screw base according to claim 1 in which the means for attachement to a lampholder fitting is a continuation of the insulative body that is an integral part of the lampholder fitting.

7. A male screw base according to claim 1 in which the outside diameter of the insulatinve body is slightly less than the minor thread diameter of a female Edison base lampholder, the helical spring outside diameter in the free condition is equal to or larger than the major thread diameter of the female Edison base lampholder, and the depth of the groove is less than the diameter of the spring wire.

* * * * *